US007071878B2

(12) United States Patent
Masutani

(10) Patent No.: US 7,071,878 B2
(45) Date of Patent: Jul. 4, 2006

(54) MULTIPLE ANTENNA

(75) Inventor: Takeshi Masutani, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 91 days.

(21) Appl. No.: 10/820,266

(22) Filed: Apr. 8, 2004

(65) Prior Publication Data

US 2004/0239568 A1 Dec. 2, 2004

(30) Foreign Application Priority Data

Apr. 11, 2003 (JP) ..... 2003-107602

(51) Int. Cl.
*H01Q 1/38* (2006.01)
*H01Q 1/48* (2006.01)

(52) U.S. Cl. ..... 343/700 MS; 343/846

(58) Field of Classification Search ..... 343/700 MS, 343/846, 844, 737, 702.846
See application file for complete search history.

(56) References Cited

U.S. PATENT DOCUMENTS 5,006,859 A * 4/1991 Wong et al. ..... 343/700 MS
5,371,507 A * 12/1994 Kuroda et al. ..... 343/700 MS
5,497,164 A * 3/1996 Croq ..... 343/700 MS
5,801,660 A * 9/1998 Ohtsuka et al. ..... 343/700 MS
5,818,391 A * 10/1998 Lee ..... 343/700 MS
5,864,318 A * 1/1999 Cosenza et al. ..... 343/700 MS
6,133,878 A * 10/2000 Lee ..... 343/700 MS
6,809,686 B1 * 10/2004 Du et al. ..... 343/700 MS

FOREIGN PATENT DOCUMENTS

JP 2002-026634 A 1/2002

* cited by examiner

*Primary Examiner*—Don Wong
*Assistant Examiner*—Hung Tran Vy
(74) *Attorney, Agent, or Firm*—RatnerPrestia

(57) ABSTRACT

A multiple antenna includes a ground electrode, a dielectric substrate placed on a top surface of the ground electrode, a planar antenna electrode disposed on a top surface of the dielectric substrate, a feeding terminal electrically coupled to the planar antenna electrode, an upper antenna electrode placed above the planar antenna electrode with a given space in between such that the upper antenna electrode faces the planar antenna electrode; and a feeding section electrically coupled to the upper antenna electrode. The upper antenna electrode has an opening facing the planar antenna electrode.

9 Claims, 6 Drawing Sheets

MULTIPLE ANTENNA

FIELD OF THE INVENTION

The present invention relates to a multiple antenna to be used in a mobile radio apparatus such as a vehicle-mounted apparatus.

BACKGROUND OF THE INVENTION

Recently some systems for providing a variety of services taking advantage of radio communication have been commercialized. In Japan for instance, the following systems are in the actual use: GPS (global positioning system) which uses satellites to measure a distance, VICS (vehicle information and communication system) which provides road-traffic information, and ETC (electronic toll collection) system which collects automatically tolls of highway. A mobile radio apparatus such as a vehicle-mounted apparatus desirably includes an antenna that can handle a plurality of frequency bands corresponding to the foregoing systems. Thus a multiple antenna incorporating individual frequency bands is demanded. A conventional multiple antenna is described hereinafter with reference to FIG. 5 and FIG. 6.

FIG. 5 shows a perspective view of the conventional multiple antenna. As shown in FIG. 5, dielectric substrate 52 made of dielectric material is prepared on the top surface of planar ground electrode 51 made of copper. On top of dielectric substrate 52, planar antenna electrodes 53*a* and 53*b* made of copper are placed in parallel with each other. Feeding points 54*a* and 54*b* of antenna electrodes 53*a* and 53*b* are respectively coupled with feeding terminals (not shown). Conventional multiple antenna 500 is thus constructed. In this structure, antenna electrode 53*a* transmits and receives signals of frequency band f1, and antenna electrode 53*b* transmits and receives signals of frequency band f2.

FIG. 6 shows a perspective view of another conventional multiple antenna, which was designed in response to the request of downsizing. In this multiple antenna, first dielectric substrate 62*a* equipped with first antenna electrode 63*a* is placed on planar ground electrode 61. First planar antenna 601 is thus constructed. On top of first planar antenna 601, second dielectric substrate 62*b* equipped with second antenna electrode 63*b* is placed. Second planar antenna 602 is thus constructed. Feeding terminals 65*a*, 65*b* extending through ground electrode 61 are respectively coupled to feeding points 64*a*, 64*b* of antenna electrodes 63*a*, 63*b*. The another conventional multiple antenna 600 is thus constructed.

In the foregoing structure, first planar antenna 601 transmits and receives signals of frequency band f1, and second planar antenna 602 transmits and receives signals of frequency band f2.

On top of second planar antenna 602, a third planar antenna is placed for transmitting and receiving signals of frequency band f3. Such a structure allows transmitting and receiving signals of three or more than three frequency bands.

The prior art discussed above is disclosed, e.g. in Japanese Patent Examined Publication No. 2002-26634.

However, since conventional multiple antenna 500 has a plurality of planar antennas, and they are placed in parallel with each other on the flat face of dielectric substrate 52, the external shape becomes so bulky that antenna 500 is unfit for being downsized.

On the other hand, another conventional multiple antenna 600, which was designed to be smaller size, has a plurality of planar antennas piled up one on another. Those planer antennas thus interfere with each other between upper one and lower one, so that the radiation efficiency lowers, and it is difficult to raise the radiation efficiency over 50%. Meanwhile the radiation efficiency is a ratio of a magnitude of an output signal vs. a magnitude of an input signal.

Multiple antenna 600 becomes higher as the number of frequency bands to be transmitted and received increases, so that antenna 600 is unfit for lowering the profile if the number of applicable frequency bands increases.

SUMMARY OF THE INVENTION

The present invention addresses the problems discussed above, and aims to provide a downsized multiple antenna that can transmit and receive a plurality of frequency bands, and can increase its radiation efficiency.

The multiple antenna of the present invention thus comprises the following elements:

(a) a ground electrode;

(b) a dielectric substrate disposed on a top surface of the ground electrode;

(c) a planar antenna electrode disposed on a top surface of the dielectric substrate;

(d) a feeding terminal electrically coupled to the planar antenna electrode;

(e) an upper antenna electrode disposed above the planar antenna electrode with a given space in-between such that the upper antenna electrode faces the planar antenna electrode; and (f) a feeding section electrically coupled to the upper antenna electrode.

Further, the upper antenna electrode has an opening which faces the planar antenna electrode. Still further, the upper antenna electrode is shaped like a ring, and a plurality of upper antenna electrodes are concentrically arranged.

The foregoing structure allows suppressing the interference between the planar antenna electrode and the upper antenna electrode(s), thereby suppressing the degradation in radiation efficiency of respective antennas. The concentric arrangement of the upper antenna electrodes allows forming the multiple antenna, which can handle a plurality of frequency bands, without increasing a volume or a height of the multiple antenna.

The multiple antenna of the present invention includes the upper antenna electrode coupled with the feeding section of which one end keeps away from and yet faces to the upper antenna electrode with a given space. Electrostatic capacitive coupling formed between the one end of the feeding section and the upper antenna electrode allows feeding.

The foregoing structure can decrease a magnitude of electromagnetic coupling between respective antennas at feeding, and an impedance matching between the feeding section and the upper antenna electrode can be done with ease.

The multiple antenna of the present invention includes the upper antenna electrodes of which ring width is wider at the outer upper antenna electrode, and the diameter of the outer upper antenna electrode is approx. equal to a length of at least one side of the planar antenna. This structure allows the multiple antenna to be further downsized.

The multiple antenna of the present invention includes the outer upper antenna electrode upheld by a plurality of supporting sections disposed outside of the planar antenna electrode and on the top surface of the dielectric substrate.

This structure allows suppressing influence of the supporting sections to the antenna characteristics of the planer antenna electrode.

DESCRIPTION OF THE PREFERRED EMBODIMENTS

Figure 1:
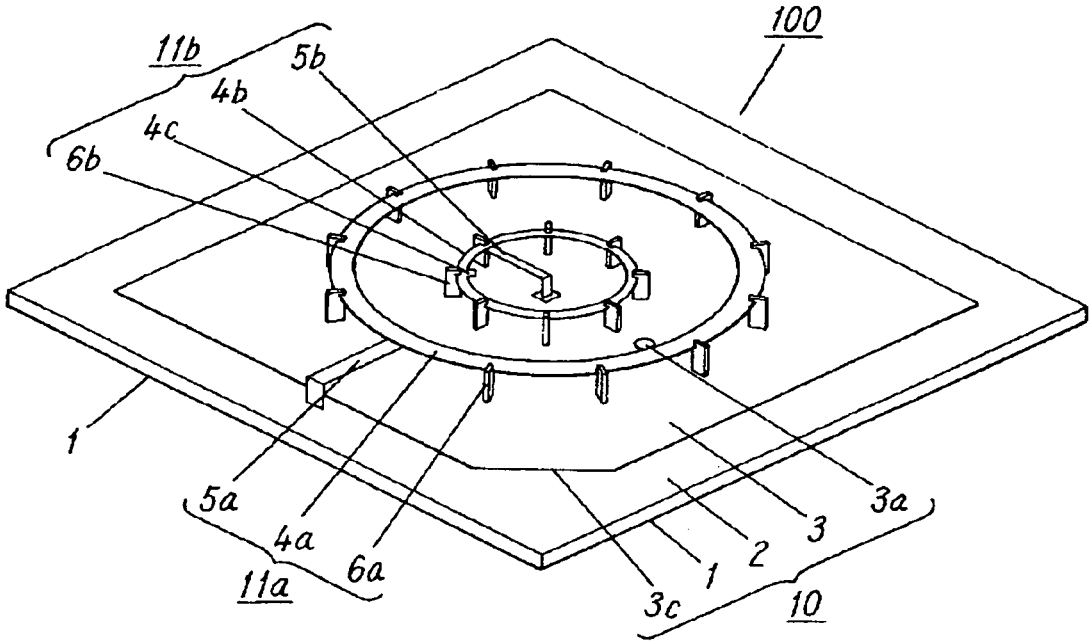
FIG. 1 shows a perspective view of a multiple antenna in accordance with a first exemplary embodiment of the present invention.
Figure 2:
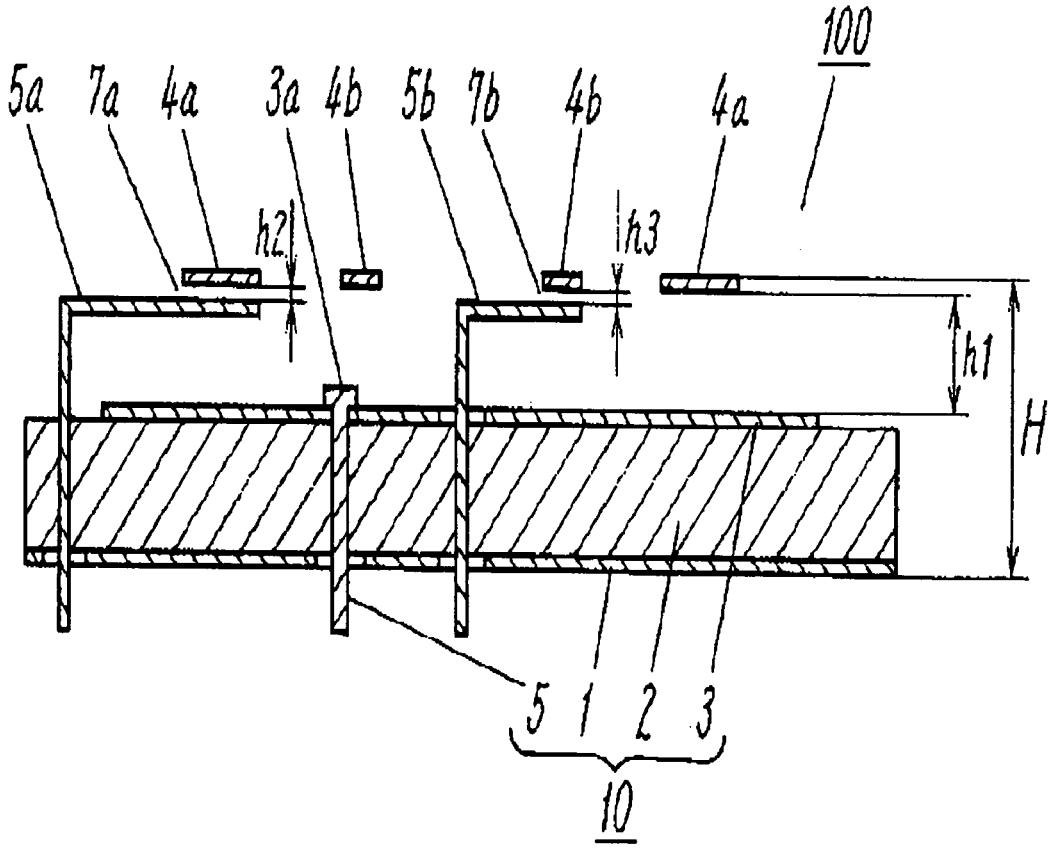
FIG. 2 shows a sectional view of an essential part of the multiple antenna shown in FIG. 1.

FIG. 1 shows a perspective view of a multiple antenna in accordance with the first exemplary embodiment of the present invention, and FIG. 2 shows a sectional view of an essential part of the multiple antenna shown in FIG. 1. As shown in FIG. 1 and FIG. 2, dielectric substrate 2 made of dielectric material is placed on the top surface of planar ground electrode 1 made of copper or copper alloy. Further on the top surface of dielectric substrate 2, planar antenna electrode 3 made of copper or copper alloy is solidly placed. Feeding point 3*a* of planar antenna electrode 3 is coupled with feeding terminal 5 passing through ground electrode 1.

Dielectric substrate 2 is formed of resin material typically such as engineering plastic including PPE (polyphenylether), PPS (polyphenylene sulfide). The foregoing structure forms patch antenna 10 that performs as a single antenna.

Further, above planer antenna electrode 3, one or plural upper antenna electrodes having one or plural openings and facing to electrode 3 are placed. In this first embodiment, ring-shaped upper antenna electrodes 4*a* and 4*b* placed concentrically, as shown in FIG. 1, are taken as examples. Electrode 4*a* is placed outside electrode 4*b*.

Upper antenna electrode 4*a* placed outside is upheld by supporting sections 6*a* made of resin, so that electrode 4*a* is placed above the top surface of planar antenna electrode 3 with a given space h1 between the top surface and electrode 4*a* as shown in FIG. 2. Outside planar antenna electrode 3, tabular outside feeding section 5*a* passes through ground electrode 1. Feeding section 5*a* is bent at approx. right angle above the top surface of planar antenna electrode 3 with a given space and extends toward upper antenna electrode 4*a*. The extending end keeps away from upper antenna electrode 4*a* with given space h2 and yet faces to electrode 4*a*. This layout generates electrostatic capacitive coupling between feeding section 5*a* and upper antenna electrode 4*a*, thereby forming coupling section 7*a* for feeding. This structure forms ring antenna 11*a* performing as another antenna.

Upper antenna electrode 4*b* placed inside upper antenna electrode 4*a*, namely, in the opening of electrode 4*a*, is upheld by supporting sections 6*b* to the height generally equal to h1, i.e. the height of upper antenna electrode 4*a*.

At a typical center of planar antenna electrode 3, tabular inner feeding section 5*b* passes through ground electrode 1. Feeding section 5*b* is bent at approx. right angle above the top surface of planar antenna electrode 3 and extends toward upper antenna electrode 4*b*. The extending end keeps away from upper antenna electrode 4*b* with given space h3 and yet faces electrode 4*b*. This layout generates electrostatic capacitive coupling between feeding section 5*b* and upper antenna electrode 4*b*, thereby forming coupling section 7*b* for feeding. This structure forms ring antenna 11*b* performing as one more antenna.

As discussed above, ring antennas 11*a* and 11*b* are concentrically placed such that they face patch antenna 10, thereby forming multiple antenna 100 in accordance with the first embodiment. In each one of those antennas, the supply of a high frequency current, having an operating frequency corresponding to each antenna, to the feeding terminal or the feeding section excites the antenna electrode electrically coupled to the feeding terminal or the feeding section, so that a transmission is carried out. A reception is carried out by the reversal operation.

Chamfered section 3*c* of planar antenna electrode 3 and projection 4*c* provided to upper antenna electrode 4*b* work as perturbation sections for the antenna to operate by circularly polarized wave.

The multiple antenna discussed above is detailed hereinafter with reference to a specific instance such as GPS using several GHz. In this instance, three frequency bands are available: first frequency f1=1.5 GHz band for GPS, second frequency f2=2.5 GHz band for VICS, and third frequency f3=5.8 GHz for ETC. A relation between those frequencies are f1<f2<f3. An assembly of the multiple antenna handling the foregoing three operating frequencies is demonstrated hereinafter.

The size of dielectric substrate 2 which determines the external size of this multiple antenna is 70 mm square that is not less than $1/\sqrt{\in}$ times of ½ wavelength of first frequency f1, and substrate 2 has a thickness of 3 mm. Ground electrode 1 formed of copper plate and having the same external shape is solidly stuck on the underside of substrate 2. Dielectric substrate 2 employs resin having relative dielectric constant $\in$=3 as the dielectric material.

Planar antenna electrode 3 to be patch antenna 10 is formed of thin copper plate, and is solidly stuck on the top surface of dielectric substrate 2. The size of planar antenna electrode 3 is 56 mm square that is equal to $1/\sqrt{\in}$ times of ½ wavelength of first frequency f1. This size allows planar antenna electrode 3 to resonate with 1.5 GHz band, i.e. first frequency f1, on dielectric substrate 2 having relative dielectric constant $\in$=3.

Next, upper antenna electrode 4*a* to be ring antenna 11*a* is formed of thin copper plate. Its radius is 19 mm that is approx. ½π (π is the ratio of circumference of a circle to its diameter) of the wavelength of second frequency f2 so that ring antenna 11*a* can resonate with second frequency f2, i.e. 2.5 GHz. The ring has 2 mm width extending between the inner circle and the outer circle of the ring. The radius extends from the center of the ring to the center line between the inner circle and the outer circle.

Upper antenna electrode 4*b* to be ring antenna 11*b* is formed of thin copper plate inside upper antenna electrode 4*a*. Its radius is 7.9 mm that is approx. ½π of the wavelength of third frequency f3 so that upper antenna electrode 4*b* can resonate with third frequency f3, i.e. 5.8 GHz. The ring has 1 mm width.

Outer upper antenna electrode 4*a* and inner upper antenna electrode 4*b* are upheld by supporting sections 6*a*, 6*b* so that both electrodes 4*a*, 4*b* can be kept away with space h1=3 mm from planar antenna electrode 3.

Space h2 at coupling section 7*a* and space h3 at coupling section 7*b* are smaller enough than space h1, thereby reducing influence of the feeding from feeding sections 5*a*, 5*b* to the antenna characteristics of planar antenna electrode 3. In this instance, space h2 is approx. equal to space h3. The impedance matching for upper antennas electrodes 4*a*, 4*b* can be done by adjusting spaces h2, h3.

The radiation efficiency η of respective antenna elements of the multiple antenna measures approx. 76%, 82%, and 76% for patch antenna 10, ring antennas 11*a* and 11*b* in this order respectively. In other words, radiation efficiency η is not less than 75% while conventional multiple antenna 600 has radiation efficiency η of approx. 50%. As a result, the multiple antenna of the present invention proves that the characteristics of multiple antenna can be improved.

According to the first exemplary embodiment discussed above, a planar antenna electrode having a first resonance frequency faces an upper antenna electrode having a second resonance frequency and being shaped like a ring having an opening. This structure suppresses the radiation efficiency to decrease, where the decrease is caused by interference between the two antennas, and achieves a downsized multiple antenna.

A plurality of upper antenna electrodes are prepared concentrically, thereby forming a multiple antenna that can transmit and receive three or more than three frequency bands without increasing its volume or height. In other words, the number of frequency bands to be transmitted and received can increase without changing the height of the multiple antenna.

An outer feeding section passes through dielectric substrate 2 outside the planar antenna electrode, yet it does not pass through the planar antenna electrode. An inner feeding section is placed such that it passes through the planar antenna electrode at a lowest potential electrodes, i.e. generally at the center. This structure reduces a magnitude of electromagnetic coupling between the respective antennas. This coupling is formed by electromagnetic field of high frequency generated during the feeding using the feeding sections. As a result, the radiation efficiency reduction caused by the interference between the antennas can be suppressed.

The multiple antenna is fed by the electrostatic capacitive coupling kept away from the upper antenna electrode, thus the impedance matching with the upper antenna electrode can be done with ease.

Exemplary Embodiment 2

Figure 3:
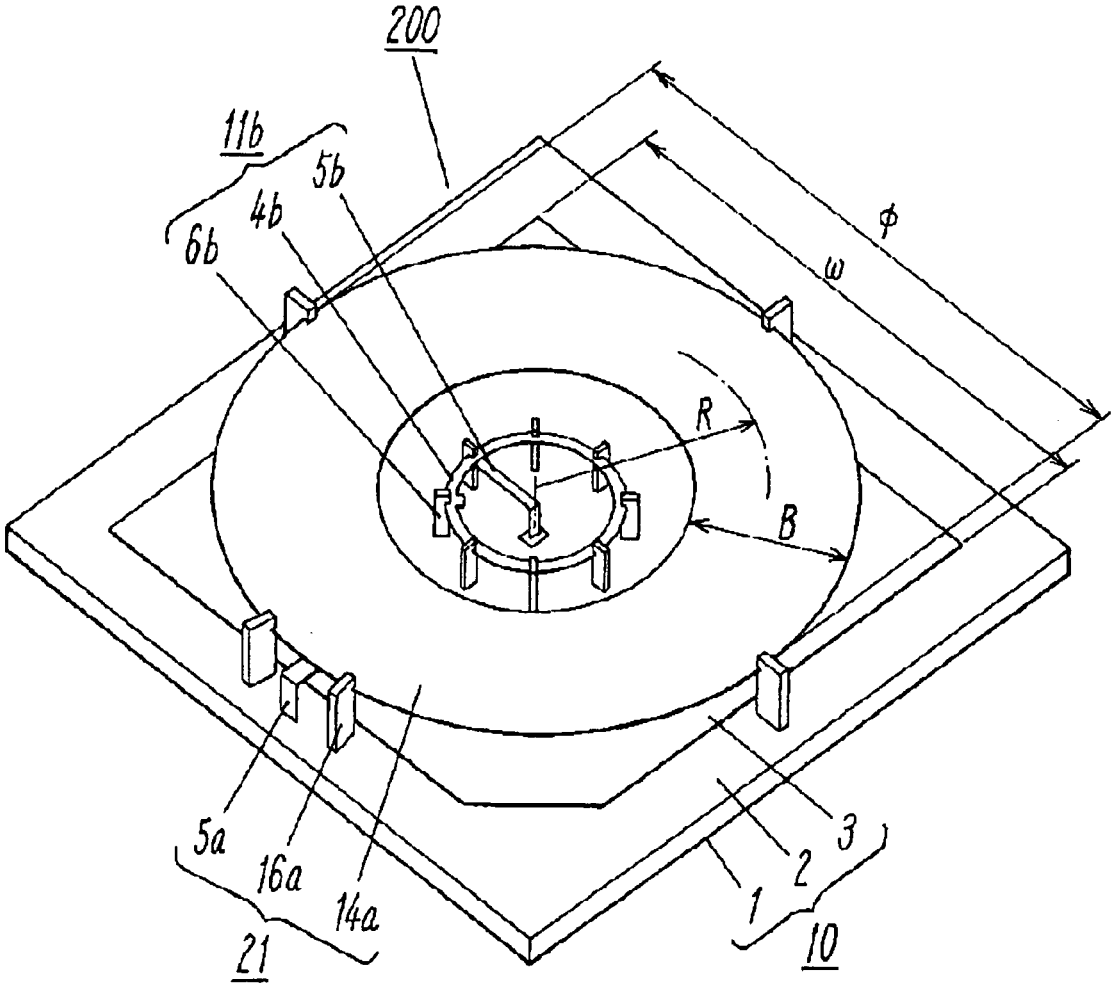
FIG. 3 shows a perspective view of a multiple antenna in accordance with a second exemplary embodiment of the present invention.

FIG. 3 shows a perspective view of a multiple antenna in accordance with the second exemplary embodiment of the present invention. In this embodiment, the multiple antenna is further downsized from that of the first embodiment. The elements similar to those in the first embodiment have the same reference marks and the descriptions thereof are simplified here.

First, dielectric substrate 2 employs resin having a greater relative dielectric constant ∈ than that used in the first embodiment. Radius R of the outer upper antenna electrode is the same as that of the first embodiment; however, its ring width B is wider than that of the first embodiment.

As shown in FIG. 3, outer upper antenna electrode 14*a* has an outer diameter, i.e. external dimension (Φ generally equal to a length of one side, i.e. external dimension "w", of planar antenna electrode 3. Further, supporting sections 16*a* which uphold upper antenna 14*a* are disposed on the top surface of dielectric substrate 2 and outside planar antenna electrode 3. Ring antenna 21 thus formed is prepared in this second embodiment.

Ring antenna 21 having an opening and facing to patch antenna 10 is placed concentrically with ring antenna 11*b*, so that multiple antenna 200 in accordance with the second embodiment is formed. Dimensions of the multiple antenna thus formed are discussed hereinafter.

The operating frequencies of respective antenna elements of the multiple antenna are the same as the those of the first embodiment. Dielectric substrate 2 made of resin of which relative dielectric constant ∈=approx. 5 is taken for example. Relative dielectric constant ∈ determines the size of the multiple antenna.

The dimensions of dielectric substrate 2 is 50 mm square that is not less than $1/\sqrt{\in}$ times of ½ wavelength of first frequency f1, i.e. 1.5 GHz, and substrate 2 has a thickness of 3 mm. In patch antenna 10, the size of planar antenna electrode 3 is 44 mm square that is equal to $1/\sqrt{\in}$ times of approx. ½ wavelength of first frequency f1. This size allows planar antenna electrode 3 to resonate with 1.5 GHz band, i.e. first frequency f1, on dielectric substrate 2 having relative dielectric constant ∈=approx. 5.

Next, in ring antenna 21, the radius R of outer upper antenna electrode 14*a* is 19 mm, the same as that of the first embodiment, which allows ring antenna 21 to resonate with second frequency f2, i.e. 2.5 GHz band. Ring width B is 9.5 mm that is a half of radius R. In this case, external dimension Φ of upper antenna electrode 14*a* can be 48 mm, which is generally equal to external dimension "w", i.e. 44 mm square, of planar antenna electrode 3.

Ring antenna 11*b* placed inside ring antenna 21 has the same structure as that of the first embodiment.

Next, the antenna characteristics of the multiple antenna in accordance with the second exemplary embodiment is described with reference to FIG. 4A and FIG. 4B.

In general, radius R is a main parameter to determine a resonance frequency of a ring antenna. Parameters such as space h1, ring width B, and relative dielectric constant ∈ of the material occupying space h1 determine the gain and the bandwidth of antenna characteristics.

Figure 4A:
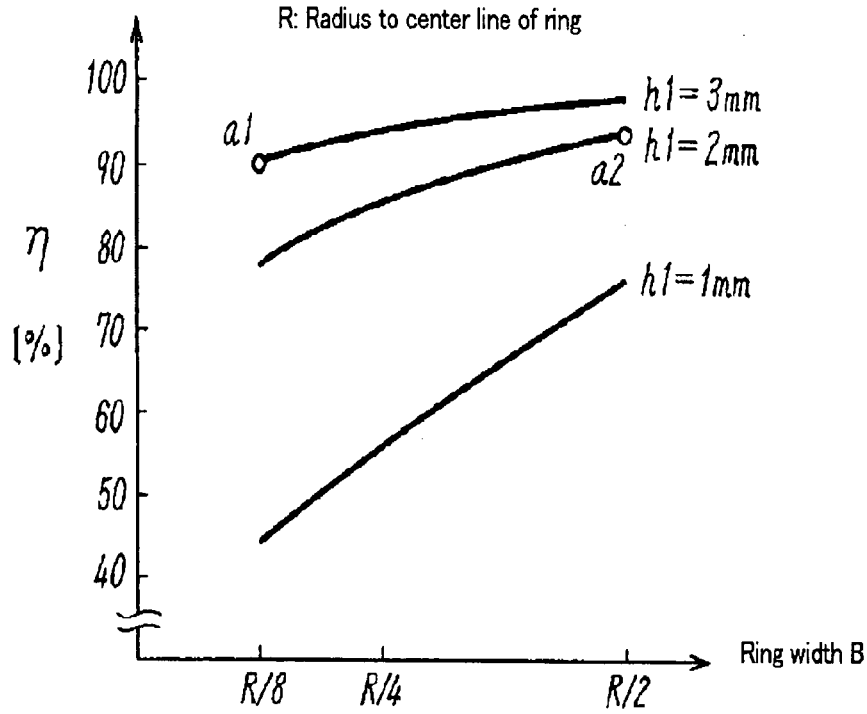
FIG. 4A shows characteristics of radiation efficiency of a multiple antenna of the present invention.
Figure 4B:
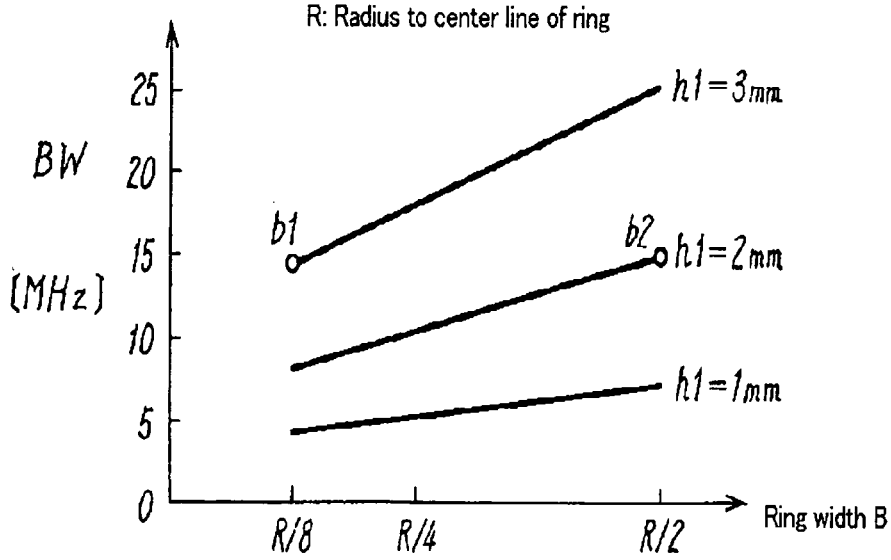
FIG. 4B shows characteristics of bandwidth of the multiple antenna of the present invention.
Figure 5:
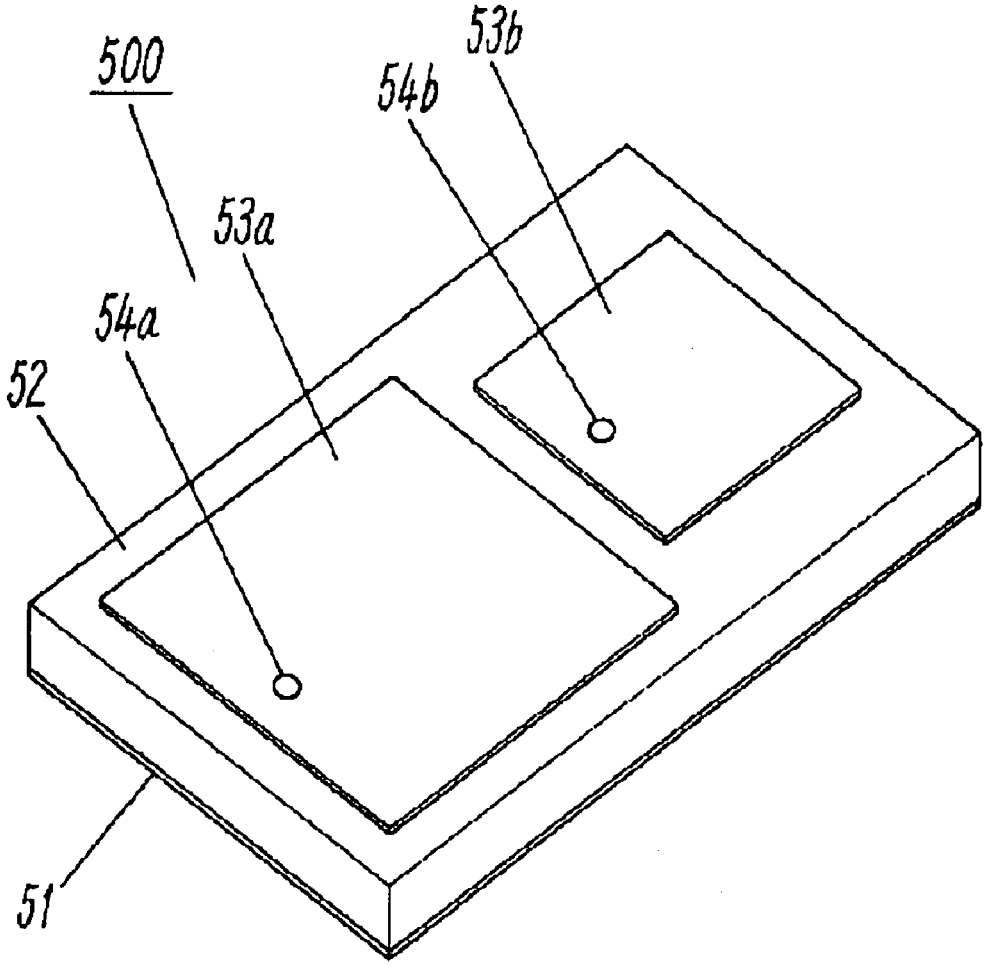
Fig.5 Prior Art
FIG. 5 shows a perspective view of a conventional multiple antenna.
Figure 6:
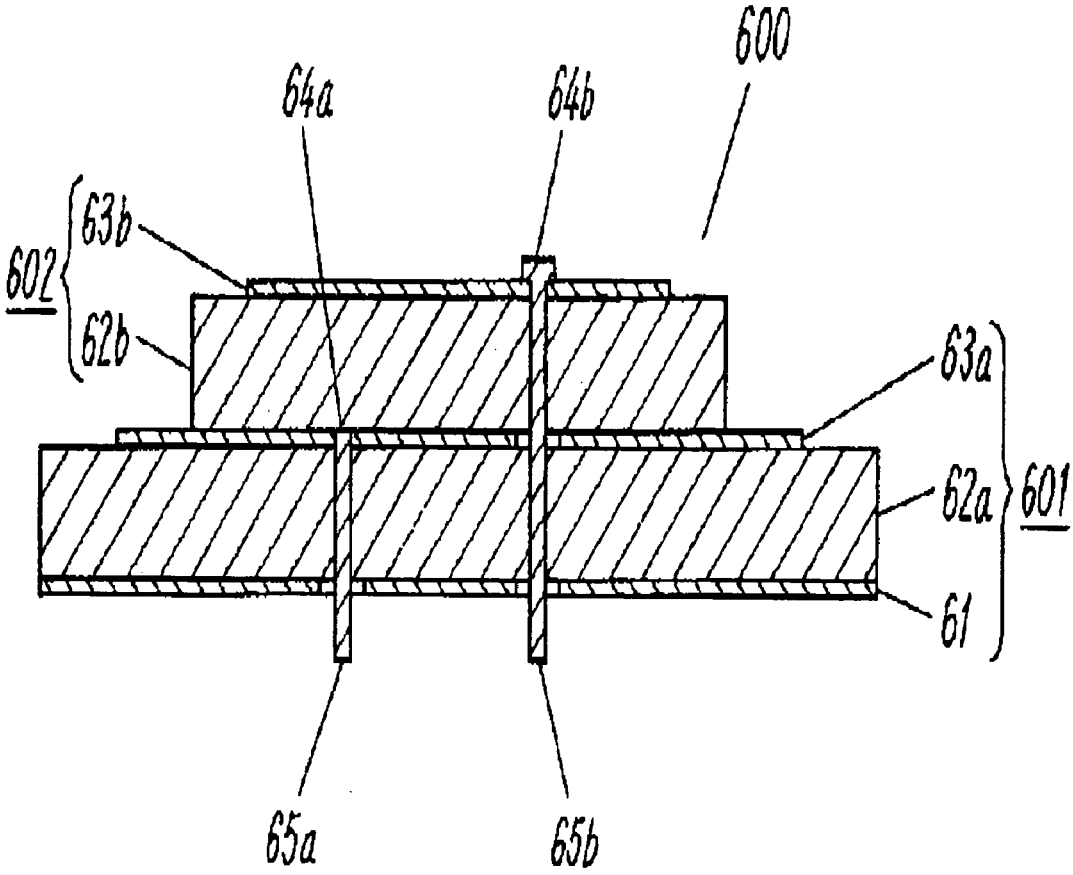
Fig.6 Prior Art
FIG. 6 shows a perspective view of another conventional multiple antenna.

FIG. 4A and FIG. 4B show the change of antenna characteristics of ring antenna 21 at the resonance frequency in response to the foregoing parameters. In this instance, the material occupies space h1 is the void, so that the relative dielectric constant ∈ is 1 (one), and outer upper antenna electrode 14*a* has a resonance frequency of 2.5 GHz band, i.e. second frequency f2.

FIG. 4A shows the characteristics of radiation efficiency η of ring antenna 21. Assume that radius R of antenna 21 stays constant, and ring width B is expressed in radius R, then radiation efficiency η [%] is simulated at space h1=1, 2, and 3 mm.

FIG. 4B shows the characteristics of the bandwidth BW of antenna 21. Assume that radius R of antenna 21 stays constant, and ring width B is expressed in radius R, then bandwidth BW[MHz] is simulated at space h1=1, 2, and 3 mm.

The simulations prove that radiation efficiency η and bandwidth BW become better at the greater ring width B of ring antenna 21 and the greater space h1 between patch antenna 10 and ring antenna 21.

The case of upper antenna electrode 4*a* demonstrated in the first embodiment is represented at point al in FIG. 4A and point b1 in FIG. 4B. To be more specific, when ring width B is ⅛ of radius R and space h1 is 3 mm, radiation efficiency η is 90% and bandwidth is approx. 14 MHz.

On the other hand, the case of upper antenna electrode 14*a* demonstrated in the second embodiment is represented at point a2 in FIG. 4A and point b2 in FIG. 4B. To be more specific, ring width B is widened to a half of radius R, so that only 2 mm of space h1 is enough to obtain radiation efficiency η=94% and bandwidth=approx. 15 MHz. As a result, the antenna can be further downsized from that of the first embodiment.

According to the second embodiment discussed above, the ring width of the outer upper antenna electrode is widened, and the external size of this upper antenna become generally equal to that of the planar antenna, so that the multiple antenna can be further downsized with the antenna characteristics maintained.

Supporting sections 16*a* uphold upper antenna electrode 14*a* at the outside of planar antenna electrode 3, so that if supporting sections 16*a* and dielectric substrate 2 are unitarily molded, supporting sections 16*a* need not pass through planar antenna electrode 3. As such, no pass-through planar antenna electrode 3 can suppress influence to the antenna characteristics of planar antenna electrode 3.

In the embodiments previously discussed, the instances adequate to 1.5 GHz for GPS, 2.5 GHz for VICS, and 5.8 GHz for ETC are taken for example; however, the present invention is not limited to those instances, but applicable to a case where a plurality of other frequency bands are combined.

The ring antenna is described as a circular ring; however, the ring antenna is not limited to a circular shape, but it can be any upper antenna electrode having an opening. For instance, a polygon is usable as the ring antenna.

According to the present invention as discussed above, an antenna shaped in a ring and having an opening is placed facing a planer patch antenna with a given space in-between. This structure advantageously keeps the radiation efficiency between the upper antenna electrode and the planar antenna electrode from lowering, and obtains a downsized multiple antenna.

What is claimed is:

1. A multiple antenna comprising:

(a) a ground electrode;

(b) a dielectric substrate disposed on a top surface of the ground electrode;

(c) a planar antenna electrode disposed on a top surface of the dielectric substrate;

(d) a feeding terminal electrically coupled to the planar antenna electrode;

(e) a first upper antenna electrode disposed above the planar antenna electrode with a given space in-between such that the upper antenna electrode faces the planar antenna electrode, the first upper antenna electrode has a first opening facing the planar antenna electrode;

(f) a second upper antenna electrode above and facing the planar antenna electrode, said second upper antenna electrode having a second opening, said second upper antenna electrode in said first opening; and (g) a feeding section electrically coupled to the first upper antenna electrode.

2. The multiple antenna of claim 1, wherein the upper antenna electrode is shaped like a ring.

3. The multiple antenna of claim 1 further comprising:

a plurality of inner upper antenna electrodes disposed above the planar antenna electrode with a given space and inside the opening of the upper antenna electrode, which is then an outer upper antenna electrode, and each one of the plurality of upper antenna electrodes facing to the planar antenna electrode; and a plurality of feeding sections electrically coupled to the plurality of inner upper antenna electrodes.

4. The multiple antenna of claim 3, wherein an end of the feeding section electrically coupled to the outer upper antenna electrode faces to and keeps away from the outer upper antenna electrode with a given space, and electrostatic capacitive coupling formed between the end of the feeding section and the outer upper antenna electrode allows feeding.

5. The multiple antenna of claim 3, wherein each one of first ends of the feeding sections electrically coupled to each one of the inner upper antenna electrodes faces to and keeps away from each one of the inner upper antenna electrodes with a given space, each one of second ends of the feeding sections passes through a general center of the planar antenna electrode and extends to an underside of the ground electrode, and electrostatic capacitive coupling formed between each one of the first ends of the feeding sections and each one of the inner upper antenna electrodes allows feeding.

6. The multiple antenna of claim 3, wherein the outer upper antenna and the inner upper antennas are shaped like rings and disposed concentrically.

7. The multiple antenna of claim 6, wherein an outer diameter of the upper outer antenna electrode is generally equal to at least one side of the planer antenna electrode.

8. The multiple antenna of claim 7, wherein the outer upper antenna electrode is upheld by a plurality of supporting sections disposed on the top surface of the dielectric substrate and outside the planar antenna electrode.

9. The multiple antenna of claim 8, wherein a ring width of the outer upper antenna electrode is generally equal to a half of a radius, where the ring width measures from an inner circle to an outer circle of the ring, and the radius measures from a center of the ring to a center line between the inner circle and the outer circle.

* * * * *